US006502625B2

(12) United States Patent
Pullum

(10) Patent No.: US 6,502,625 B2
(45) Date of Patent: Jan. 7, 2003

(54) HAND-HELD CASTING DEVICE FOR MOLDING A HOLLOW POINTED, GROOVED, AND TWICE THROUGHBORED BULLET

(76) Inventor: Johnie R. Pullum, 730 New Jersey Ave., Brooklyn, NY (US) 11207

( * ) Notice: Subject to any disclaimer, the term of this patent is extended or adjusted under 35 U.S.C. 154(b) by 0 days.

(21) Appl. No.: 09/791,379

(22) Filed: Feb. 23, 2001

(65) Prior Publication Data

US 2002/0117287 A1 Aug. 29, 2002

(51) Int. Cl.[7] ..... B22D 33/04

(52) U.S. Cl. ..... 164/340; 164/342; 164/264; 249/171; 249/177

(58) Field of Search ..... 164/340, 342, 164/264; 249/170, 171, 172, 177

(56) References Cited

U.S. PATENT DOCUMENTS

| | | | | |
|---|---|---|---|---|
| 3,749,351 A | * | 7/1973 | Lee | 249/170 |
| 4,788,915 A | | 12/1988 | Sauvestre | 102/439 |
| 4,838,339 A | | 6/1989 | French | 164/340 |
| 5,187,325 A | | 2/1993 | Garvison | 102/509 |
| 5,275,110 A | | 1/1994 | Flatau | 102/503 |
| 5,357,866 A | | 10/1994 | Schluckebier et al. | 102/509 |
| 5,943,749 A | | 8/1999 | Swank | 29/1.22 |

* cited by examiner

*Primary Examiner*—Kuang Y. Lin
(74) *Attorney, Agent, or Firm*—Richart L. Miller, P.C.

(57) ABSTRACT

A hand-held casting device for molding a hollow pointed, grooved, and twice throughbored bullet including a pair of handles, a pair of jaws, a mold, a pin, and a bracket. The mold includes first and second halves and two rods passing at different elevations and orthogonally into the mold for providing the two throughbores in the bullet. The length of the bracket is such that upon opening the mold, the pin moves in contact with the mold first half until such time as the bracket contacts the mold second half forcing the pin to leave the mold first half and move towards the mold second half until such time as the bracket contacts the mold first half causing the mold to no longer be able to separate and positioning the pin equidistantly between the mold first and second halves.

63 Claims, 2 Drawing Sheets

HAND-HELD CASTING DEVICE FOR MOLDING A HOLLOW POINTED, GROOVED, AND TWICE THROUGHBORED BULLET

BACKGROUND OF THE INVENTION

1. Field of the Invention

The present invention relates to a hand-held casting device. More particularly, the present invention relates to a hand-held casting device for molding a hollow pointed, grooved, and twice throughbored bullet.

2. Description of the Prior Art

Numerous innovations for bullet related devices have been provided in the prior art that will be described. Even though these innovations may be suitable for the specific individual purposes to which they address, however, they differ from the present invention.

A FIRST EXAMPLE, U.S. Pat. No. 4,788,915 to Sauvestre teaches hunting ammunition for a fire-arm of the kind having a subcaliber bullet fitted with a feathering, the subcaliber bullet allowing for destabilization on its trajectory beyond a distance travelled outside of the fire-arm.

A SECOND EXAMPLE, U.S. Pat. No. 4,838,339 to French teaches a mold for a grooved hollow point bullet having a pair of separable mold halves which are mounted in a bullet molding apparatus for movement between a closed position and an open position. Each mold half has a flat parting surface which has a bullet shaped groove and an elongated shallow groove which extends from the bullet shaped groove to one end of the mold half. When the mold halves are in the closed position so that the parting surfaces of the mold halves abut, the bullet shaped grooves of the mold halves combine to form a bullet shaped cavity and the elongated shallow grooves combine to form a bore which leads from the bullet shaped cavity to the end of the mold. An elongated pin for forming a hollow point bullet is mounted on one of the mold halves so that it extends through the bore and into the bullet cavity. The pin is mounted on one of the mold halves so that it remains with the mold half throughout the casting process, including the separation of the mold halves and ejection of the cast bullet from the mold.

A THIRD EXAMPLE, U.S. Pat. No. 5,187,325 to Garvison teaches a cylindrical bullet or projectile having imbedded coaxially in lead or like bullet metal, an internal expansion control insert of copper or like bullet-jacketing metal. The insert has a cylindrical outer surface having a common cylindrical interface with the outer portion of the bullet. The inner surface of the insert has a star-shaped configuration constituted by lead-filled, axially-disposed, V-shaped channels the apices of which are adjacent the outer surface of the insert and the sides of which flare out symmetrically about radii to an intercept with the hollow core of the bullet which extends from a position at or near the base of the bullet as a cylindrical surface to a position at or near the nose of the bullet whereupon it extends on an inverted, frusto-conical surface to the nose-end of the bullet. The points of the stars are truncated on an arcuate surface and the base of the lead-filled channels have a complementary curvature so that the inner surface of bullet is formed of arcuate panels of lead alternating with arcuate panels of malleable bullet-sheathing copper. These panels are shaped by an axial core of the mold which has a top shaped as an inverted, frustrum of a cone and sides that first are parallel and then coverage to a point at the nose-end of the bullet. The bullet thus has a plurality of segments that are separated by portions of weakness and peel back on impact to effect mushrooming of the bullet.

A FOURTH EXAMPLE, U.S. Pat. No. 5,275,110 to Flatau teaches a small arms projectile containing a series of vents or apertures in a geometric arrangement such that the projectile's leading edge is capable of penetrating the target without structural failure and depositing the majority of its residual energy in the target. In addition, the design of the body allows the projectile to be spin stabilized when fired from any suitable weapon.

A FIFTH EXAMPLE, U.S. Pat. No. 5,357,866 to Schluckebier et al. teaches a jacketed hollow point bullet having a lead core and the method of making same with the core having a downwardly extending cavity having side portions terminating adjacent the peripheral edge of the jacket, with slits being formed in the peripheral edge of the jacket and down through the adjacent side portions of the core.

A SIXTH EXAMPLE, U.S. Pat. No. 5,943,749 to Swank teaches a method of manufacturing a hollow point bullet. A cavity is formed in an end portion of a slug of generally solid material. A plurality of grooves are formed on an outer surface of the end portion of the slug. A slit it cut through a portion of each of the grooves substantially adjacent a peripheral edge of the end portion. The end portion of the slug is contoured so that the bullet has a desired shape and geometry.

It is apparent that numerous innovations for bullet related devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a hand-held casting device for molding a hollow pointed, grooved, and twice throughbored bullet that avoids the disadvantages of the prior art.

ANOTHER OBJECT of the present invention is to provide a hand-held casting device for molding a hollow pointed, grooved, and twice throughbored bullet that is simple and inexpensive to manufacture.

STILL ANOTHER OBJECT of the present invention is to provide a hand-held casting device for molding a hollow pointed, grooved, and twice throughbored bullet that is simple to use.

BRIEFLY STATED, STILL YET ANOTHER OBJECT of the present invention is to provide a hand-held casting device for molding a hollow pointed, grooved, and twice throughbored bullet including a pair of handles, a pair of jaws, a mold, a pin, and a bracket. The mold has first and second halves and two rods passing at different elevations and orthogonally into the mold for providing the two throughbores in the bullet. The length of the bracket is such that upon opening the mold, the pin moves in contact with the mold first half until such time as the bracket contacts the mold second half forcing the pin to leave the mold first half and move towards the mold second half until such time as the bracket contacts the mold first half causing the mold to no longer be able to separate and positioning the pin equidistantly between the mold first and second halves.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
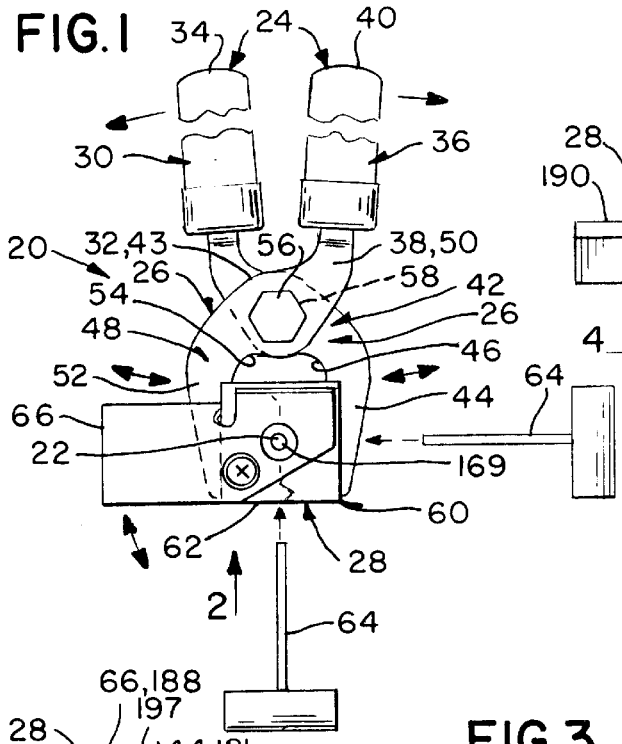
FIG. 1 is a diagrammatic plan view of the present invention in use.
Figure 2:
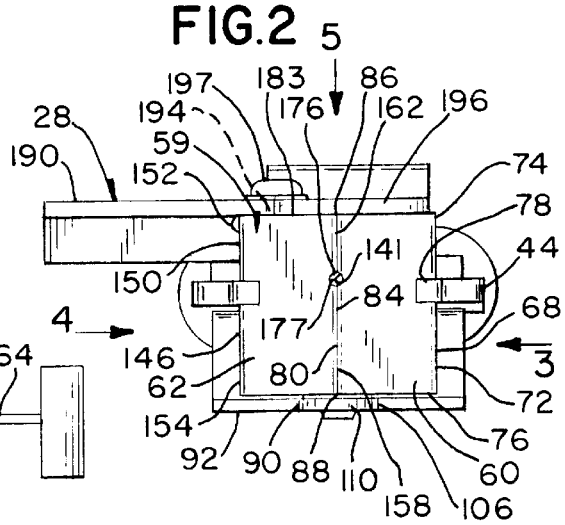
FIG. 2 is an enlarged diagrammatic front elevational view taken generally in the direction of arrow 2 in FIG. 1.
Figure 3:
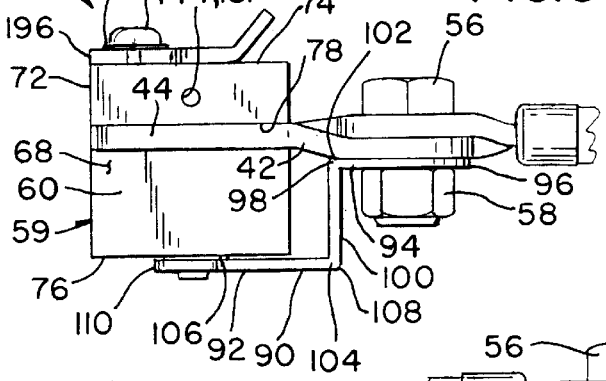
FIG. 3 is a diagrammatic left side elevational view taken generally in the direction of arrow 3 in FIG. 2.
Figure 4:
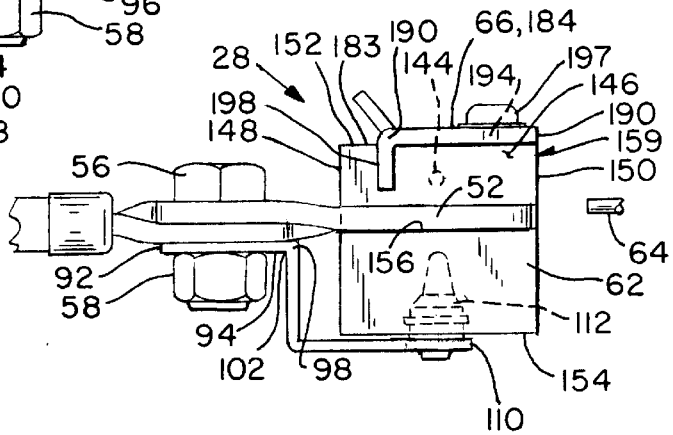
FIG. 4 is a diagrammatic right side elevational view taken generally in the direction of arrow 4 in FIG. 2.
Figure 5:
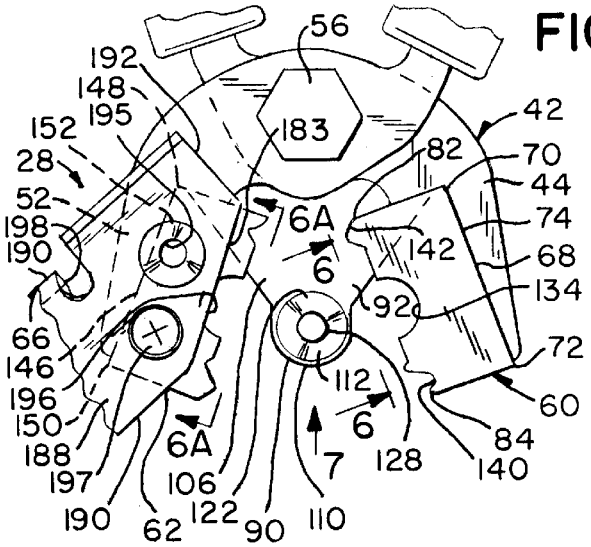
FIG. 5 is an enlarged fragmented diagrammatic top plan view taken generally in the direction of arrow 5 in FIG. 2.
Figure 6:
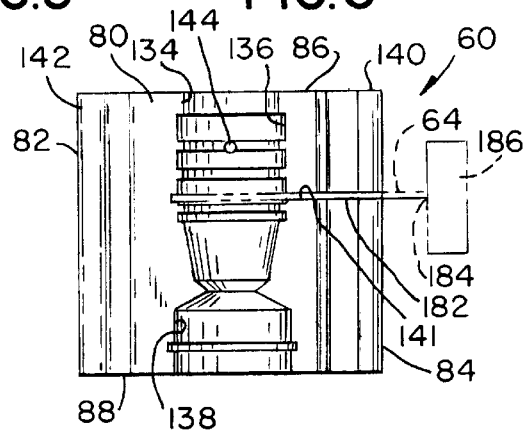
FIG. 6 is an enlarged diagrammatic elevational view taken on line 6—6 in FIG. 5.

20 hand-held casting device of present invention for molding hollow pointed, grooved, and twice throughbored bullet 22

22 hollow pointed, grooved, and twice throughbored bullet 22

24 pair of handles

26 pair of jaws

28 mold assembly for molding hollow pointed, grooved, and twice throughbored bullet 22 when pair of handles 24 are pulled towards each other and molten lead is poured into mold assembly 28

30 first handle of pair of handles 24

32 proximal end of first handle 30 of pair of handles 24

34 distal end of first handle 30 of pair of handles 24

36 second handle of pair of handles 24

38 proximal end of second handle 36 of pair of handles 24

40 distal end of second handle 36 of pair of handles 24

42 first jaw of pair of jaws 26

43 proximal end of first jaw 42 of pair of jaws 26

44 distal end of first jaw 42 of pair of jaws 26

46 inner surface of distal end 44 of first jaw 42 of pair of jaws 26

48 second jaw of pair of jaws 26

50 proximal end of second jaw 48 of pair of jaws 26

52 distal end of second jaw 48 of pair of jaws 26

54 inner surface of distal end 52 of second jaw 48 of pair of jaws 26

56 bolt of pair of jaws 26

58 nut of pair of jaws 26

59 mold of mold assembly 28

60 first half of mold 59 of mold assembly 28

62 second half of mold 59 of mold assembly 28

64 two rods of mold 59 of mold assembly 28 for providing two throughbores in hollow pointed, grooved, and twice throughbored bullet 22

66 sprue cutter of mold assembly 28

68 outermost surface of first half 60 of mold 59 of mold assembly 28

70 rearwardmost edge of outermost surface 68 of first half 60 of mold 59 of mold assembly 28

72 forwardmost edge of outermost surface 68 of first half 60 of mold 59 of mold assembly 28

74 uppermost edge of outermost surface 68 of first half 60 of mold 59 of mold assembly 28

76 lowermost edge of outermost surface 68 of first half 60 of mold 59 of mold assembly 28

78 groove in outermost surface 68 of first half 60 of mold 59 of mold assembly 28

80 innermost surface of first half 60 of mold 59 of mold assembly 28

82 rearwardmost edge of innermost surface 80 of first half 60 of mold 59 of mold assembly 28

84 forwardmost edge of innermost surface 80 of first half 60 of mold 59 of mold assembly 28

86 uppermost edge of innermost surface 80 of first half 60 of mold 59 of mold assembly 28

88 lowermost edge of innermost surface 80 of first half 60 of mold 59 of mold assembly 28

90 pin assembly of mold assembly 28

92 bracket of pin assembly 90 of mold assembly 28

94 upper portion of bracket 92 of pin assembly 90 of mold assembly 28

96 apex of upper portion 94 of bracket 92 of pin assembly 90 of mold assembly 28

98 base of upper portion 94 of bracket 92 of pin assembly 90 of mold assembly 28

100 intermediate portion of bracket 92 of pin assembly 90 of mold assembly 28

102 uppermost long edge of intermediate portion 100 of bracket 92 of pin assembly 90 of mold assembly 28

104 lowermost long edge of intermediate portion 100 of bracket 92 of pin assembly 90 of mold assembly 28

106 lower portion of bracket 92 of pin assembly 90 of mold assembly 28

108 base of lower portion 106 of bracket 92 of pin assembly 90 of mold assembly 28

110 apex of lower portion 106 of bracket 92 of pin assembly 90 of mold assembly 28

112 pin of pin assembly 90 of mold assembly 28

114 lower portion of pin 112 of pin assembly 90 of mold assembly 28

116 lowermost surface of lower portion 114 of pin 112 of pin assembly 90 of mold assembly 28

118 uppermost surface of lower portion 114 of pin 112 of pin assembly 90 of mold assembly 28

120 ring of lower portion 114 of pin 112 of pin assembly 90 of mold assembly 28

122 intermediate portion of pin 112 of pin assembly 90 of mold assembly 28

124 lowermost surface of intermediate portion 122 of pin 112 of pin assembly 90 of mold assembly 28

126 uppermost surface of intermediate portion 122 of pin 112 of pin assembly 90 of mold assembly 28

128 upper portion of pin 112 of pin assembly 90 of mold assembly 28 for forming hollow point in hollow pointed, grooved, and twice throughbored bullet 22

130 lowermost surface of upper portion 128 of pin 112 of pin assembly 90 of mold assembly 28
132 uppermost surface of upper portion 128 of pin 112 of pin assembly 90 of mold assembly 28
134 primary groove in innermost surface 80 of first half 60 of mold 59 of mold assembly 28
136 uppermost portion of primary groove 134 in innermost surface 80 of first half 60 of mold 59 of mold assembly 28 for forming half of, hollow pointed, grooved, and twice throughbored bullet 22
138 lowermost portion of primary groove 134 in innermost surface 80 of first half 60 of mold 59 of mold assembly 28
140 secondary groove in innermost surface 80 of first half 60 of mold 59 of mold assembly 28
141 tertiary groove in innermost surface 80 of first half 60 of mold 59 of mold assembly 28
142 ridge on innermost surface 80 of first half 60 of mold 59 of mold assembly 28
144 throughbore in first half 60 of mold 59 of mold assembly 28
146 outermost surface of second half 62 of mold 59 of mold assembly 28
148 rearwardmost edge of outermost surface 146 of second half 62 of mold 59 of mold assembly 28
150 forwardmost edge of outermost surface 146 of second half 62 of mold 59 of mold assembly 28
152 uppermost edge of outermost surface 146 of second half 62 of mold 59 of mold assembly 28
154 lowermost edge of outermost surface 146 of second half 62 of mold 59 of mold assembly 28
156 groove in outermost surface 146 of second half 62 of mold 59 of mold assembly 28
158 innermost surface of second half 62 of mold 59 of mold assembly 28
160 rearwardmost edge of innermost surface 158 of second half 62 of mold 59 of mold assembly 28
162 forwardmost edge of innermost surface 158 of second half 62 of mold 59 of mold assembly 28
164 uppermost edge of innermost surface 158 of second half 62 of mold 59 of mold assembly 28
166 lowermost edge of innermost surface 158 of second half 62 of mold 59 of mold assembly 28
168 primary groove in innermost surface 158 of second half 62 of mold 59 of mold assembly 28
169 conjoined throughbore in mold 59 of mold assembly 28
170 uppermost portion of primary groove 168 in innermost surface 158 of second half 62 of mold 59 of mold assembly 28 for forming other half of, hollow pointed, grooved, and twice throughbored bullet 22
172 lowermost portion of primary groove 168 in innermost surface 158 of second half 62 of mold 59 of mold assembly 28
174 secondary groove in innermost surface 158 of second half 62 of mold 59 of mold assembly 28
176 tertiary groove in innermost surface 158 of second half 62 of mold 59 of mold assembly 28
177 first bore in mold 59 of mold assembly 28
178 ridge on innermost surface 158 of second half 62 of mold 59 of mold assembly 28
180 blindbore in innermost surface 158 of second half 62 of mold 59 of mold assembly 28
181 second bore in mold 59 of mold assembly 28
182 shaft of each rod of two rods 64
183 top surface of second half 62 of mold 59 of mold assembly 28
184 proximal end of shaft 182 of each rod of two rods 64
186 handle of each rod of two rods 64
188 plate of sprue cutter 66
190 pair of long sides of plate 188 of sprue cutter 66
192 pair of short sides of plate 188 of sprue cutter 66
194 throughbore in plate 188 of sprue cutter 66
195 countersunk throughbore in plate 188 of sprue cutter 66
196 straight edge of plate 188 of sprue cutter 66
197 screw of sprue cutter 66
198 side wall of plate 188 of sprue cutter 66
200 jacket
202 cartridge

DETAILED DESCRIPTION OF THE PREFERRED EMBODIMENT

Referring now to the figures, in which like numerals indicate like parts, and particularly to FIG. 1, the hand-held casting device of the present invention is shown generally at 20 for molding a hollow pointed, grooved, and twice throughbored bullet 22, wherein the hollow pointed, grooved, and twice throughbored bullet 22 has a length.

The overall configuration of the hand-held casting device 20 can best be seen in FIG. 1, and as such, will be discussed with reference thereto.

The hand-held casting device 20 comprises a pair of handles 24, a pair of jaws 26 that are affixed to, and move with, the pair of handles 24, and a mold assembly 28 that is affixed to, and moves with, the pair of jaws 26 for molding the hollow pointed, grooved, and twice throughbored bullet 22 when the pair of handles 24 are squeezed towards each other and molten lead is poured into the mold assembly 28.

The specific configuration of the pair of handles 24 and the pair of jaws 26 can best be seen in FIG. 1, and as such, will be discussed with reference thereto.

The pair of handles 24 comprise a first handle 30 that is slender, elongated, straight, and has a proximal end 32 and a distal end 34 that is free.

The pair of handles 24 further comprise a second handle 36 that is slender, elongated, straight, has a proximal end 38 and a distal end 40 that is free, and moves relative to the first handle 30 thereof.

The pair of jaws 26 comprise a first jaw 42 that is flat, and has a proximal end 43 that is coincident with the proximal end 32 of, and is integral with, the first handle 30.

The first jaw 42 extends serpentiningly from the proximal end 43 thereof to a distal end 44 that is free, tapering, and has an inner surface 46 that is straight and flat.

The pair of jaws 26 further comprise a second jaw 48 that moves relative to the first jaw 42, is flat, and has a proximal end 50 that is coincident with the proximal end 38 of, and is integral with, the second handle 36.

The second jaw 48 extends serpentiningly from the proximal end 50 thereof to a distal end 52 that is free, tapering, and has an inner surface 54 that is straight, flat, and faces the inner surface 46 of the distal end 44 of the first jaw 42.

The second jaw 48 overlaps, and is pivotally attached to, the first jaw 42 by a bolt 56 that extends through the proximal end 50 of the second jaw 48 and then through the proximal end 43 of the first jaw 42 where it is maintained thereat by a nut 58 so as to allow the pair of jaws 26 to move towards each other when the pair of handles 24 are moved towards each other and vise versa.

The overall configuration of the mold assembly 28 can best be seen in FIG. 1, and as such, will be discussed with reference thereto.

The mold assembly 28 comprises a mold 59 that is cubically-shaped and comprises a first half 60 that is affixed to the first jaw 42 and a second half 62 that is affixed to the second jaw 48 and independent of the first half 60, and two rods 64 that pass at different elevations from each other orthogonally into the mold 59 for providing the two through-bores in the hollow pointed, grooved, and twice through-bored bullet 22.

The mold assembly 28 further comprises a sprue cutter 66 that is pivotally attached to the second half 62 of the mold 59 thereof.

The specific configuration of the mold assembly 28 can best be seen in FIGS. 1–7, and as such, will be discussed with reference thereto.

The mold assembly 28 further comprises a pin assembly 90 that is pivotally mounted on the bolt 56, between the nut 58 and the first jaw 42.

The pin assembly 90 comprises a bracket 92 that is pivotally mounted on the bolt 56, between the nut 58 and the first jaw 42.

The bracket 92 has an upper portion 94 that is isosceles-triangular-shaped, and has an apex 96 that is pivotally mounted on the bolt 56, between the nut 58 and the first jaw 42, and a base 98 that faces the first half 60 of the mold 59 and the second half 62 of the mold 59.

The bracket 92 further has an intermediate portion 100 that is rectangular-shaped, depends perpendicularly from the upper portion 94 thereof, and has an uppermost long edge 102 that is coincident with the base 98 of the upper portion 94 thereof and has a length, and a lowermost long edge 104.

The bracket 92 further has a lower portion 106 that is isosceles-triangular-shaped, extends perpendicularly forwardly from the intermediate portion 100 thereof, and has a base 108 that is coincident with the lowermost long edge 104 of the intermediate portion 100 thereof, and an apex 110.

The pin assembly 90 further comprises a pin 112 that has a shape, a height, and extends fixedly upwardly from the apex 110 of the lower portion 106 of the bracket 92, into the mold 59.

The pin 112 has a lower portion 114 that is cylindrically-shaped and extends upwardly from the apex 110 of the lower portion 106 of the bracket 92.

The lower portion 114 of the pin 112 has a lowermost surface 116 that is disposed on the apex 110 of the lower portion 106 of the bracket 92, and an uppermost surface 118.

The lower portion 114 of the pin 112 further has a ring 120 that extends circumferentially therearound, and is disposed parallel to, and midway between, the lowermost surface 116 thereof and the uppermost surface 118 thereof.

The pin 112 further has an intermediate portion 122 that is conically-frustrum-shaped and extends coaxially upwardly from the lower portion 114 thereof.

The intermediate portion 122 of the pin 112 has a lowermost surface 124 that is coincident with the uppermost surface 118 of lower portion 114 thereof, and an uppermost surface 126 that is coaxial with, and smaller than, the lowermost surface 124 thereof.

The pin 112 further has an upper portion 128 that is conically-shaped and extends coaxially upwardly from the intermediate portion 122 thereof.

The upper portion 128 of the pin 112 has a lowermost surface 130 that is coincident with the uppermost surface 126 of the intermediate portion 122 thereof, an uppermost surface 132 that is rounded, and coaxial with, and smaller than, the lowermost surface 130 thereof, and a shape for forming the hollow point in the hollow pointed, grooved, and twice throughbored bullet 22.

The first half 60 of the mold 59 is rectangular-parallelepiped-shaped and has an outermost surface 68 that is square-shaped and has a rearwardmost edge 70, a forwardmost edge 72, an uppermost edge 74, and a lowermost edge 76.

The outermost surface 68 of the first half 60 of the mold 59 further has a groove 78 that is straight, extends from, and opens into, the rearwardmost edge 70 thereof to, and opens into, the forwardmost edge 72 thereof, is disposed intermediate the lowermost edge 76 thereof, and, but closer to, the uppermost edge 74 thereof, and fixedly receives the inner surface 46 of the distal end 44 of the first jaw 42 so as to attach the first half 60 of the mold 59 to the first jaw 42.

The groove 78 in the outermost surface 68 of the first half 60 of the mold 59 is square-shaped in lateral cross section.

The first half 60 of the mold 59 further has an innermost surface 80 that is square-shaped and has a rearwardmost edge 82, a forwardmost edge 84, an uppermost edge 86, and a lowermost edge 88.

The innermost surface 80 of the first half 60 of the mold 59 further has a primary groove 134 that extends from, and opens into, the uppermost edge 86 thereof to, and opens into, the lowermost edge 88 thereof, and is disposed midway between the rearwardmost edge 82 thereof and the forwardmost edge 84 thereof.

The primary groove 134 in the innermost surface 80 of the first half 60 of the mold 59 has an uppermost portion 136 that extends from, and open into, the uppermost edge 86 of the innermost surface 80 of the first half 60 of the mold 59 to the length of, and has a shape for forming half of, the hollow pointed, grooved, and twice throughbored bullet 22, and receives substantially half of the upper portion 128 of the pin 112 for forming half of the hollow point of the hollow pointed, grooved, and twice throughbored bullet 22.

The primary groove 134 in the innermost surface 80 of the first half 60 of the mold 59 further has a lowermost portion 138 that extends from, and open into, the lowermost edge 88 of the innermost surface 80 of the first half 60 of the mold 59 to, and communicates coaxially with, the uppermost portion 136 thereof, and has the height of, and the shape of substantially half, the pin 112 so as to complementary receive substantially half the pin 112 when the mold 59 is closed by squeezing the pair of handles 24 together.

The innermost surface 80 of the first half 60 of the mold 59 further has a secondary groove 140 that is straight and extends from, and opens into, the uppermost edge 86 thereof to, and opens into, the lowermost edge 88 thereof, and is disposed parallel and adjacent to the forwardmost edge 84 thereof.

The secondary groove 140 in the innermost surface 80 of the first half 60 of the mold 59 is triangular-shaped in lateral cross section.

The innermost surface 80 of the first half 60 of the mold 59 further has a tertiary groove 141 that is straight and extends from, and opens into, the forwardmost edge 84 thereof to, and communicates perpendicularly with, the upper portion 136 of the primary groove 134 therein, and then slightly therepast, and is disposed parallel to the uppermost surface 86 thereof and approximately midway along the upper portion 136 of the primary groove 134 therein.

The tertiary groove 141 in the innermost surface 80 of the first half 60 of the mold 59 is semi-circular-shaped in lateral cross section.

The innermost surface 80 of the first half 60 of the mold 59 further has a ridge 142 thereon that is straight and extends from the uppermost edge 86 thereof to the lowermost edge 88 thereof, and is disposed parallel and adjacent to the rearwardmost edge 82 thereof.

The ridge 142 on the innermost surface 80 of the first half 60 of the mold 59 is triangular-shaped in lateral cross section.

The first half 60 of the mold 59 further has a throughbore 144 that is straight and extends from, and opens into, the outermost surface 68 thereof to, and communicates perpendicularly with, the upper portion 136 of the primary groove 134 therein, and is disposed approximately midway between the uppermost edge 74 of the outermost surface 68 thereof and the groove 78 in the outermost surface 68 thereof.

The throughbore 144 in the first half 60 of the mold 59 is disposed above, and perpendicular to, the tertiary groove 141 in the innermost surface 80 of the first half 60 of the mold 59.

The throughbore 144 in the first half 60 of the mold 59 is circular-shaped in lateral cross section.

The second half 62 of the mold 59 is rectangular-parallelepiped-shaped and has an outermost surface 146 that is square-shaped and has a rearwardmost edge 148, a forwardmost edge 150, an uppermost edge 152, and a lowermost edge 154.

The outermost surface 146 of the second half 62 of the mold 59 further has a groove 156 that is straight, extends from, and opens into, the rearwardmost edge 148 thereof to, and opens into, the forwardmost edge 150 thereof, is disposed intermediate the lowermost edge 154 thereof, and, but closer to, the uppermost edge 152 thereof, and fixedly receives the inner surface 54 of the distal end 52 of the second jaw 48 so as to attach the second half 62 of the mold 59 to the second jaw 42.

The groove 156 in the outermost surface 146 of the second half 62 of the mold 59 is square-shaped in lateral cross section.

The second half 62 of the mold 59 further has an innermost surface 158 that is square-shaped, has a rearwardmost edge 160, a forwardmost edge 162, an uppermost edge 164, and a lowermost edge 166, and faces the innermost surface 80 of the first half 60 of the mold 59.

The innermost surface 158 of the second half 62 of the mold 59 further has a primary groove 168 that extends from, and opens into, the uppermost edge 164 thereof to, and opens into, the lowermost edge 166 thereof, is disposed midway between the rearwardmost edge 160 thereof and the forwardmost edge 162 thereof, and is identical to, and aligns with, the primary groove 134 in the innermost surface 80 of the first half 60 of the mold 59 when the mold 59 is closed by squeezing the pair of handles 24 together, and when aligned therewith, forms a conjoined throughbore 169.

The primary groove 168 in the innermost surface 158 of the second half 62 of the mold 59 has an uppermost portion 170 that is identical to, and aligned with, the uppermost portion 136 of the primary groove 134 in the innermost surface 80 of the first half 60 of the mold 59 when the mold 59 is closed by squeezing the pair of handles 24 together, extends from, and open into, the uppermost edge 164 of the innermost surface 158 of the second half 62 of the mold 59 to the length of, and has a shape for forming the other half of, the hollow pointed, grooved, and twice throughbored bullet 22, and receives substantially the other half of the upper portion 128 of the pin 112 for forming the other half of the hollow point of the hollow pointed, grooved, and twice throughbored bullet 22.

The primary groove 168 in the innermost surface 158 of the second half 62 of the mold 59 further has a lowermost portion 172 that is identical to, and aligned with, the lowermost portion 138 of the primary groove 134 in the innermost surface 80 of the first half 60 of the mold 59 when the mold 59 is closed by squeezing the pair of handles 24 together, extends from, and open into, the lowermost edge 166 of the innermost surface 158 of the second half 62 of the mold 59 to, and communicates coaxially with, the uppermost portion 170 thereof, and has the height of, and the shape of substantially the other half of, the pin 112 so as to complementary receive substantially the other half of the pin 112 when the mold 59 is closed by squeezing the pair of handles 24 together.

The innermost surface 158 of the second half 62 of the mold 59 further has a secondary groove 174 that is straight and extends from, and opens into, the uppermost edge 164 thereof to, and opens into, the lowermost edge 166 thereof, is disposed parallel and adjacent to the rearwardmost edge 160 thereof, and complementary receives the ridge 142 on the innermost surface 80 of the first half 60 of the mold 59 when the pair of handles 24 are squeezed together causing the innermost surface 80 of the first half 60 of the mold 59 to abut against, and be aligned with, the innermost surface 158 of the second half 62 of the mold 59.

The secondary groove 174 in the innermost surface 158 of the second half 62 of the mold 59 is triangular-shaped in lateral cross section.

The innermost surface 158 of the second half 62 of the mold 59 further has a tertiary groove 176 that is straight and extends from, and opens into, the forwardmost edge 162 thereof to, and communicates perpendicularly with, the upper portion 170 of the primary groove 168 therein, and then slightly therepast, is disposed parallel to the uppermost surface 164 thereof and approximately midway along the upper portion 170 of the primary groove 168 therein, and is identical to, and aligns with the tertiary groove 141 in the innermost surface 80 of the first half 62 of the mold 59 when the mold 59 is closed by squeezing the pair of handles 24 together so as to form a first bore 177 that replaceably receives one rod 64 for forming one throughbore of the hollow pointed, grooved, and twice throughbored bullet 22.

The tertiary groove 176 in the innermost surface 158 of the second half 62 of the mold 59 is semi-circular-shaped in lateral cross section.

The innermost surface 158 of the second half 62 of the mold 59 further has a ridge 178 thereon that is straight and extends from the uppermost edge 164 thereof to the lowermost edge 166 thereof, and is disposed parallel and adjacent to the forwardmost edge 162 thereof, and complementary enters the secondary groove 140 in the innermost surface 80 of the first half 60 of the mold 59 when the pair of handles 24 are squeezed together causing the innermost surface 80 of the first half 60 of the mold 59 to abut against, and be further aligned with, the innermost surface 158 of the second half 62 of the mold 59.

The ridge 178 on the innermost surface 158 of the second half 62 of the mold 59 is triangular-shaped in lateral cross section.

The innermost surface 158 of the second half 62 of the mold 59 further has a blindbore 180 that is straight and communicates perpendicularly with the upper portion 170 of the primary groove 168, is disposed approximately midway between the uppermost edge 164 thereof and the tertiary groove 176 therein, and aligns with the throughbore 144 in the first half 60 of the mold 59 when the mold 59 is closed by squeezing the pair of handles 24 together so as to form a second bore 181 that replaceably receives the other rod 64 for forming the other throughbore of the hollow pointed, grooved, and twice throughbored bullet 22.

The second half 62 of the mold 59 further has a top surface 183.

The throughbore 180 in the second half 62 of the mold 59 is disposed above, and perpendicular to, the tertiary groove 176 in the innermost surface 158 of the second half 62 of the mold 59.

The throughbore 180 in the second half 62 of the mold 59 is circular-shaped in lateral cross section.

Each rod 64 comprises a shaft 182 that is straight, slender, elongated, replaceably fills an associated one of the first bore 177 in the mold 59 and the second bore 181 in the mold 59, and has a proximal end 184 that extends past the mold 59, and a handle 186 that is disposed on the proximal end 184 of, and is perpendicular to, the shaft 182 so as to form a T-shape therewith for facilitating holding thereof.

The length of the intermediate portion 100 of the bracket 92 is such that upon opening the mold 59, by separating the pair of handles 24 from each other, the pin 112 moves in contact with the first half 60 of the mold 59 until such time as one end of the intermediate portion 100 of the bracket 92 contacts the second half 62 of the mold 59 forcing the pin 112 to leave the first half 60 of the mold 59 and move towards the second half 62 of the mold 59 until such time as the other end of the intermediate portion 100 of the bracket 92 contacts the first half 60 of the mold 59 causing the mold 59 to no longer be able to separate and positioning the pin 112 equidistantly between the first half 60 of the mold 59 and the second half 62 of the mold 59.

The sprue cutter 66 is a plate 188 that is pivotally attached to the top surface 183 of the second half 62 of the mold 59.

The plate 188 is substantially rectangular-shaped, and has a pair of long sides 190 and a pair of short sides 192.

The plate 188 further has a throughbore 194 that is disposed approximately midway between the pair of short sides 192 thereof, adjacent one long side 190 thereof, and receives a screw 196 that threadably engages into the top surface 183 of the second half 62 of the mold 59 so as to allow the plate 188 to pivot relative to the top surface 183 of the second half 62 of the mold 59.

The plate 188 further has a countersunk throughbore 195 that is disposed approximately midway between the throughbore 194 therein and one short side 192 thereof, and approximately midway between the pair of long sides 190 thereof, and is alignable with conjoined throughbore 169 in the mold 59, and when aligned therewith, allows molten lead to be poured therethrough and into the conjoined throughbore 169 in the mold 59 for forming the hollow pointed, grooved, and twice throughbored bullet 22.

The plate 188 is truncated by a straight edge 196 that extends from the one long side 190 thereof, adjacent the throughbore 194 therein, to approximately midway along one short edge 192 thereof so as to provide clearance for the conjoined throughbore 169 in the mold 59 when the plate 188 is pivoted away therefrom so as to allow the mold 59 to be opened and the hollow pointed, grooved, and twice throughbored bullet 22 removed therefrom.

The plate 188 further has a side wall 198 that depends from, and extends approximately halfway along, the other long side 190 thereof, from the other short side 192 thereof, and provides a stop for the plate 188 when the plate 188 is pivoted so as to assure that the countersunk throughbore 195 therein is aligned with the conjoined throughbore 195 in the mold 59 for pouring the molten lead.

Figure 8:
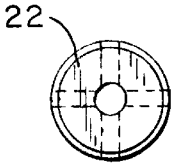
FIG. 8 is a diagrammatic top plan view taken generally in the direction of arrow 8 in FIG. 7.
Figure 7:
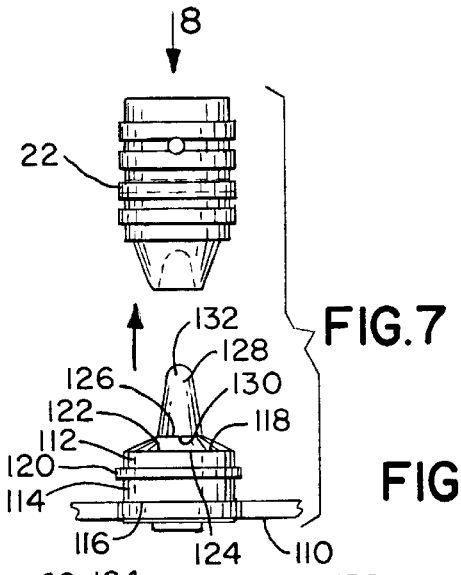
FIG. 7 is an enlarged fragmented exploded diagrammatic front elevational view taken generally in the direction of arrow 7 in FIG. 5 with the hollow point and twice throughbored bullet being removed from the present invention.

Shown in FIG. 8 is the completed hollow pointed, grooved, and twice throughbored bullet 22.

Figure 9:
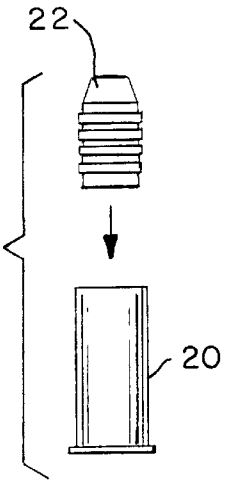
FIG. 9 is an exploded diagrammatic side elevational view of the hollow point and twice throughbored bullet molded by the present invention being inserted into a jacket.

Shown in FIG. 9 is the completed hollow pointed, grooved, and twice throughbored bullet 22 being inserted into a jacket 200.

Figure 10:
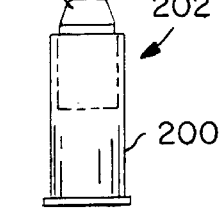
FIG. 10 is a diagrammatic side elevational view of the hollow point and twice throughbored bullet molded by the present invention in the jacket so as to form a completed cartridge.
Figure 6A:
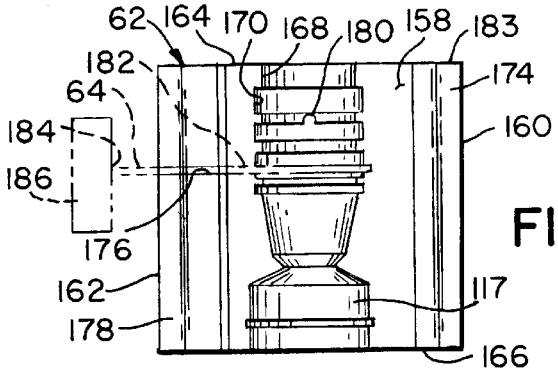
FIG. 6A is an enlarged diagrammatic elevational view taken on line 6A—6A in FIG. 5.

Shown in FIG. 10 is the completed hollow pointed, grooved, and twice throughbored bullet 22 inserted into the jacket 200 so as to form a cartridge 202.

It will be understood that each of the elements described above, or two or more together, may also find a useful application in other types of constructions differing from the types described above.

While the invention has been illustrated and described as embodied in a hand-held casting device for molding a hollow pointed, grooved, and twice throughbored bullet, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A hand-held casting device for molding a hollow pointed, grooved, and twice throughbored bullet, wherein the hollow pointed, grooved, and twice throughbored bullet has a length, said device comprising:

a) a pair of handles;

b) a pair of jaws affixed to, and moving with, said pair of handles; and c) a mold assembly affixed to, and moving with, said pair of jaws for molding the hollow pointed, grooved, and twice throughbored bullet when said pair of handles are squeezed towards each other and molten lead is poured into said mold assembly;

wherein said mold assembly comprises a mold that is cubically-shaped and comprises: 1) first half that is affixed to said first jaw; 2) a second half that is affixed to said second jaw and independent of said first half; and 3) two rods that pass at different elevations from each other orthogonally into said mold for providing the two throughbores in said hollow pointed, grooved, and twice throughbored bullet.

2. The device as defined in claim 1, wherein said pair of handles comprise a first handle that is slender, elongated, straight, and has:

a) a proximal end; and b) a distal end that is free.

3. The device as defined in claim 2, wherein said pair of handles further comprise a second handle that is slender, elongated, straight, moves relative to said first handle thereof, and has:

a) a proximal end; and b) a distal end that is free.

4. The device as defined in claim 3, wherein said pair of jaws comprise a first jaw that is flat, and has a proximal end that is coincident with said proximal end of, and is integral with, said first handle.

5. The device as defined in claim 4, wherein said first jaw extends serpentiningly from said proximal end thereof to a distal end that is free, tapering, and has an inner surface that is straight and flat.

6. The device as defined in claim 5, wherein said pair of jaws further comprise a second jaw that moves relative to said first jaw, is flat, and has a proximal end that is coincident with said proximal end of, and is integral with, said second handle.

7. The device as defined in claim 6, wherein said second jaw extends serpentiningly from said proximal end thereof to a distal end that is free, tapering, and has an inner surface that is straight, flat, and faces said inner surface of said distal end of said first jaw.

8. The device as defined in claim 7, wherein said second jaw overlaps, and is pivotally attached to, said first jaw by a bolt that extends through said proximal end of said second jaw and then through said proximal end of said first jaw where it is maintained thereat by a nut so as to allow said pair of jaws to move towards each other when said pair of handles are moved towards each other and vise versa.

9. The device as defined in claim 1, wherein said mold assembly further comprises a sprue cutter that is pivotally attached to said second half of said mold thereof.

10. The device as defined in claim 1, wherein said mold assembly further comprises a pin assembly that is pivotally mounted on said bolt, between said nut and said first jaw.

11. The device as defined in claim 10, wherein said pin assembly comprises a bracket that is pivotally mounted on said bolt, between said nut and said first jaw.

12. The device as defined in claim 11, wherein said bracket has an upper portion that is isosceles-triangular-shaped, and has:

a) an apex that is pivotally mounted on said bolt, between said nut and said first jaw; and b) a base that faces said first half of said mold and said second half of said mold.

13. The device as defined in claim 12, wherein said bracket further has an intermediate portion that is rectangular-shaped, depends perpendicularly from said upper portion thereof, and has:

a) an uppermost long edge that is coincident with said base of said upper portion thereof and has a length; and b) a lowermost long edge.

14. The device as defined in claim 13, wherein said bracket further has a lower portion that is isosceles-triangular-shaped, extends perpendicularly forwardly from said intermediate portion thereof, and has:

a) a base that is coincident with said lowermost long edge of said intermediate portion thereof; and b) an apex.

15. The device as defined in claim 14, wherein said pin assembly further comprises a pin that extends fixedly upwardly from said apex of said lower portion of said bracket, into said mold.

16. The device as defined in claim 15, wherein said pin has a lower portion that is cylindrically-shaped and extends upwardly from said apex of said lower portion of said bracket.

17. The device as defined in claim 16, wherein said lower portion of said pin has:

a) a lowermost surface that is disposed on said apex of said lower portion of said bracket; and b) an uppermost surface.

18. The device as defined in claim 17, wherein said lower portion of said pin further has a ring that extends circumferentially therearound, and is disposed parallel to, and midway between, said lowermost surface thereof and said uppermost surface thereof.

19. The device as defined in claim 17, wherein said pin further has an intermediate portion that is conically-frustrum-shaped and extends coaxially upwardly from said lower portion thereof.

20. The device as defined in claim 19, wherein said intermediate portion of said pin has:

a) a lowermost surface that is coincident with said uppermost surface of said lower portion thereof; and b) an uppermost surface that is coaxial with, and smaller than, said lowermost surface thereof.

21. The device as defined in claim 20, wherein said pin further has an upper portion that is conically-shaped and extends coaxially upwardly from said intermediate portion thereof.

22. The device as defined in claim 21, wherein said upper portion of said pin has:

a) a lowermost surface that is coincident with said uppermost surface of said intermediate portion thereof;

b) an uppermost surface that is rounded, and coaxial with, and smaller than, said lowermost surface thereof; and c) a shape for forming the hollow point in the hollow pointed, grooved, and twice throughbored bullet.

23. The device as defined in claim 21, wherein said first half of said mold is rectangular-parallelepiped-shaped and has an outermost surface that is square-shaped and has:

a) a rearwardmost edge;

b) a forwardmost edge;

c) an uppermost edge; and d) a lowermost edge.

24. The device as defined in claim 23, wherein said outermost surface of said first half of said mold further has a groove that is straight, extends from, and opens into, said rearwardmost edge thereof to, and opens into, said forwardmost edge thereof, is disposed intermediate said lowermost edge thereof, and, but closer to, said uppermost edge thereof, and fixedly receives said inner surface of said distal end of said first jaw so as to attach said first half of said mold to said first jaw.

25. The device as defined in claim 24, wherein said groove in said outermost surface of said first half of said mold is squareshaped in lateral cross section.

26. The device as defined in claim 24, wherein said first half of said mold further has an innermost surface that is squareshaped and has:

a) a rearwardmost edge;

b) a forwardmost edge;

c) an uppermost edge; and d) a lowermost edge.

27. The device as defined in claim 26, wherein said innermost surface of said first half of said mold further has a primary groove that extends from, and opens into, said uppermost edge thereof to, and opens into, said lowermost edge thereof, and is disposed midway between said rearwardmost edge thereof and said forwardmost edge thereof.

28. The device as defined in claim 27, wherein said primary groove in said innermost surface of said first half of said mold has an uppermost portion that extends from, and open into, said uppermost edge of said innermost surface of said first half of said mold to the length of, and has a shape for forming half of, the hollow pointed, grooved, and twice throughbored bullet, and receives substantially half of said upper portion of said pin for forming half of the hollow point of the hollow pointed, grooved, and twice throughbored bullet.

29. The device as defined in claim 28, wherein said primary groove in said innermost surface of said first half of said mold further has a lowermost portion that extends from, and open into, said lowermost edge of said innermost surface of said first half of said mold to, and communicates coaxially with, said uppermost portion thereof, and has said height. of, and said shape of substantially half of, said pin so as to complementary receive substantially half of said pin when said mold is closed by squeezing said pair of handles together.

30. The device as defined in claim 29, wherein said innermost surface of said first half of said mold further has a secondary groove that is straight and extends from, and opens into, said uppermost edge thereof to, and opens into, said lowermost edge thereof, and is disposed parallel and adjacent to said forwardmost edge thereof.

31. The device as defined in claim 30, wherein said secondary groove in said innermost surface of said first half of said mold is triangular-shaped in lateral cross section.

32. The device as defined in claim 30, wherein said innermost surface of said first half of said mold further has a tertiary groove that is straight and extends from, and opens into, said forwardmost edge thereof to, and communicates perpendicularly with, said upper portion of said primary groove therein, and then slightly therepast, and is disposed parallel to said uppermost surface thereof and approximately midway along said upper portion of said primary groove therein.

33. The device as defined in claim 32, wherein said tertiary groove in said innermost surface of said first half of said mold is semi-circular-shaped in lateral,cross section.

34. The device as defined in claim 32, wherein said innermost surface of said first half of said mold further has a ridge thereon that is straight and extends from said uppermost edge thereof to said lowermost edge thereof, and is disposed parallel and adjacent to said rearwardmost edge thereof.

35. The device as defined in claim 34, wherein said ridge on said innermost surface of said first half of said mold is triangular-shaped in lateral cross section.

36. The device as defined in claim 34, wherein said first half of said mold further has a throughbore that is straight and extends from, and opens into, said outermost surface thereof to, and communicates perpendicularly with, said upper portion of said primary groove therein, and is disposed approximately midway between said uppermost edge of said outermost surface thereof and said groove in said outermost surface thereof.

37. The device as defined in claim 36, wherein said throughbore in said first half of said mold is disposed above, and perpendicular to, said tertiary groove in said innermost surface of said first half of said mold.

38. The device as defined in claim 36, wherein said throughbore in said first half of said mold is circular-shaped in lateral cross section.

39. The device as defined in claim 1, wherein said second half of said mold is rectangular-parallelepiped-shaped and has an outermost surface that is square-shaped and has:

a) a rearwardmost edge;

b) a forwardmost edge;

c) an uppermost edge; and d) a lowermost edge.

40. The device as defined in claim 39, wherein said outermost surface of said second half of said mold further has a groove that is straight, extends from, and opens into, said rearwardmost edge thereof to, and opens into, said forwardmost edge thereof, is disposed intermediate said lowermost edge thereof, and, but closer to, said uppermost edge thereof, and fixedly receives said inner surface of said distal end of said second jaw so as to attach said second half of said mold to said second jaw.

41. The device as defined in claim 40, wherein said groove in said outermost surface of said second half of said mold is squareshaped in lateral cross section.

42. The device as defined in claim 36, wherein said second half of said mold further has an innermost surface that is square-shaped, faces said innermost surface of said first half of said mold, and has:

a) a rearwardmost edge;

b) a forwardmost edge;

c) an uppermost edge; and d) a lowermost edge.

43. The device as defined in claim 42, wherein said innermost surface of said second half of said mold further has a primary groove that extends from, and opens into, said uppermost edge thereof to, and opens into, said lowermost edge thereof, is disposed midway between said rearwardmost edge thereof and said forwardmost edge thereof, and is identical to, and aligns with, said primary groove in said innermost surface of said first half of said mold when said mold is closed by squeezing said pair of handles together, and when aligned therewith, forms a conjoined throughbore.

44. The device as defined in claim 43, wherein said primary groove in said innermost surface of said second half of said mold has an uppermost portion that is identical to, and aligned with, said uppermost portion of said primary groove in said innermost surface of said first half of said mold when said mold is closed by squeezing said pair of handles together, extends from, and open into, said uppermost edge of said innermost surface of said second half of said mold to said length of, and has a shape for forming the other half of, the hollow pointed, grooved, and twice throughbored bullet, and receives substantially the other half of said upper portion of said pin for forming the other half of the hollow point of the hollow pointed, grooved, and twice throughbored bullet.

45. The device as defined in claim 44, wherein said primary groove in said innermost surface of said second half of said mold further has a lowermost portion that is identical to, and aligned with, said lowermost portion of said primary groove in said innermost surface of said first half of said mold when said mold is closed by squeezing said pair of handles together, extends from, and open into, said lowermost edge of said innermost surface of said second half of said mold to, and communicates coaxially with, said uppermost portion thereof, and has said height of and said shape of substantially the other half of, said pin so as to complementary receive substantially said other half of said pin when said mold is closed by squeezing said pair of handles together.

46. The device as defined in claim 42, wherein said innermost surface of said second half of said mold further has a secondary groove that is straight and extends from, and opens into, said uppermost edge thereof to, and opens into, said lowermost edge thereof, is disposed parallel and adjacent to said rearwardmost edge thereof, and complementary receives said ridge on said innermost surface of said first half of said mold when said pair of handles are squeezed together causing said innermost surface of said first half of said mold to abut against, and be aligned with, said innermost surface of said second half of said mold.

47. The device as defined in claim 46, wherein said secondary groove in said innermost surface of said second half of said mold is triangular-shaped in lateral cross section.

48. The device as defined in claim 44, wherein said innermost surface of said second half of said mold further has a tertiary groove that is straight and extends from, and opens into, said forwardmost edge thereof to, and communicates perpendicularly with, said upper portion of said primary groove therein, and then slightly therepast, is disposed parallel to said uppermost surface thereof and approximately midway along said upper portion of said primary groove therein, and is identical to, and aligns with said tertiary groove in said innermost surface of said first half of said mold when said mold is closed by squeezing said pair of handles together so as to form a first bore that replaceably receives one rod for forming one throughbore of the hollow pointed, grooved, and twice throughbored bullet.

49. The device as defined in claim 48, wherein said tertiary groove in said innermost surface of said second half of said mold is semi-circular-shaped in lateral cross section.

50. The device as defined in claim 42, wherein said innermost surface of said second half of said mold further has a ridge thereon that is straight and extends from said uppermost edge thereof to said lowermost edge thereof, and is disposed parallel and adjacent to said forwardmost edge thereof, and complementary enters said secondary groove in said innermost surface of said first half of said mold when said pair of handles are squeezed together causing said innermost surface of said first half of said mold to abut against, and be further aligned with, said innermost surface of said second half of said mold.

51. The device as defined in claim 50, wherein said ridge on said innermost surface of said second half of said mold is triangular-shaped in lateral cross section.

52. The device as defined in claim 48, wherein said innermost surface of said second half of said mold further has a blindbore that is straight and communicates perpendicularly with said upper portion of said primary groove, is disposed approximately midway between said uppermost edge thereof and said tertiary groove therein, and aligns with said throughbore in said first half of said mold when said mold is closed by squeezing said pair of handles together so as to form a second bore that replaceably receives the other rod for forming the other throughbore of the hollow pointed, grooved, and twice throughbored bullet.

53. The device as defined in claim 48, wherein said throughbore in said second half of said mold is disposed above, and perpendicular to, said tertiary groove in said innermost surface of said second half of said mold.

54. The device as defined in claim 52, wherein said throughbore in said second half of said mold is circular-shaped in lateral cross section.

55. The device as defined in claim 52, wherein each rod comprises:

a) a shaft that is straight, slender, elongated, replaceably fills an associated one of said first bore in said mold and said second bore in said mold, and has a proximal end that extends past said mold; and b) a handle that is disposed on said proximal end of, and is perpendicular to, said shaft so as to form a T-shape therewith for facilitating holding thereof.

56. The device as defined in claim 19, wherein said length of said intermediate portion of said bracket is such that upon opening said mold, by separating said pair of handles from each other, said pin moves in contact with said first half of said mold until such time as one end of said intermediate portion of said bracket contacts said second half of said mold forcing said pin to leave said first half of said mold and move towards said second half of said mold until such time as the other end of said intermediate portion of said bracket contacts said first half of said mold causing said mold to no longer be able to separate and positioning said pin equidistantly between said first half of said mold and said second half of said mold.

57. The device as defined in claim 43, wherein said second half of said mold further has a top surface.

58. The device as defined in claim 57, wherein said sprue cutter is a plate that is pivotally attached to said top surface of said second half of said mold.

59. The device as defined in claim 58, wherein said plate is substantially rectangular-shaped, and has:

a) a pair of long sides; and b) a pair of short sides.

60. The device as defined in claim 59, wherein said plate further has a throughbore that is disposed approximately midway between said pair of short sides thereof, adjacent one long side thereof, and receives a screw that threadably engages into said top surface of said second half of said mold so as to allow said plate to pivot relative to said top surface of said second half of said mold.

61. The device as defined in claim 60, wherein said plate further has a countersunk throughbore that is disposed approximately midway between said throughbore therein and one short side thereof, and approximately midway between said pair of long sides thereof, and is alignable with said conjoined throughbore in said mold, and when aligned therewith, allows molten lead to be poured therethrough and into said conjoined throughbore in said mold for forming the hollow pointed, grooved, and twice throughbored bullet.

62. The device as defined in claim 60, wherein said plate is truncated by a straight edge that extends from said one long side thereof, adjacent said throughbore therein, to approximately midway along one short edge thereof so as to provide clearance for said conjoined throughbore in said mold when said plate is pivoted away therefrom so as to allow said mold to be opened and the hollow pointed, grooved, and twice throughbored bullet removed therefrom.

63. The device as defined in claim 61, wherein said plate further has a side wall that depends from, and extends approximately halfway along, the other long side thereof, from the other short side thereof, and provides a stop for said plate when said plate is pivoted so as to assure that said countersunk throughbore therein is aligned with said conjoined throughbore in said mold for pouring the molten lead.

* * * * *